US005239969A

United States Patent [19]

Beaty

[11] Patent Number: 5,239,969

[45] Date of Patent: Aug. 31, 1993

[54] MECHANICAL FUEL INJECTOR FOR INTERNAL COMBUSTION ENGINES

[75] Inventor: Kevin D. Beaty, Bexar, Tex.

[73] Assignee: Southwest Research Institute, San Antonio, Tex.

[21] Appl. No.: 773,040

[22] Filed: Oct. 8, 1991

[51] Int. Cl.[5] ..... F02M 23/00

[52] U.S. Cl. ..... 123/531; 123/459

[58] Field of Search ..... 123/531, 533, 575, 459

[56] References Cited

U.S. PATENT DOCUMENTS

| | | | |
|---|---|---|---|
| 2,173,812 | 9/1939 | Bischof . | |
| 2,711,720 | 5/1951 | Nallinger . | |
| 2,991,055 | 7/1961 | Powell | 123/459 |
| 3,011,489 | 12/1961 | Bessiere . | |
| 3,749,097 | 7/1973 | Grow | 123/575 |
| 3,800,770 | 4/1974 | Baribeau | 123/459 |
| 4,075,996 | 2/1978 | Hisserich | 123/575 |
| 4,224,915 | 9/1980 | Emmenthal | 123/533 |
| 4,368,714 | 1/1983 | Emmenthal | 123/531 |
| 4,378,774 | 4/1983 | Kato . | |
| 4,381,077 | 4/1983 | Tsumura | 123/531 |
| 4,462,372 | 7/1984 | Jackson | 123/459 |
| 4,646,706 | 3/1987 | Emmenthal | 123/459 |
| 4,926,806 | 5/1990 | Ahern | 123/531 |
| 4,951,631 | 8/1990 | Eckert . | |
| 5,035,223 | 7/1991 | Watanabe | 123/459 |

*Primary Examiner*—Carl S. Miller
*Attorney, Agent, or Firm*—Baker & Botts

[57] ABSTRACT

Purely mechanical fuel injector for internal combustion engines utilizes a single plunger piston within a plunger barrel for fuel pumping, fuel/air mixing, and fuel injection functions. The plunger piston is reciprocated by a cam follower engaging a cam rotated by the engine. The fuel injector utilizes a fuel bypass valve to meter fuel to the fuel injector and/or bypass fuel to the fuel tank in response to the position of the air throttle valve on the engine air intake. Air is entrained into the fuel supply through an air fed mixing venturi.

39 Claims, 2 Drawing Sheets

MECHANICAL FUEL INJECTOR FOR INTERNAL COMBUSTION ENGINES

TECHNICAL FIELD OF THE INVENTION

The present invention generally relates to fuel injectors for internal combustion engines and, more particularly, is concerned with a simple, purely mechanical fuel injection system for gasoline engines.

BACKGROUND OF THE INVENTION

In recent years, fuel injectors have largely replaced carburetors as a means for providing a controlled quantity of fuel to internal combustion engines. Fuel injected internal combustion engines have several advantages over carbureted engines:

(1) reduced hydrocarbon emissions;

(2) greater fuel economy due to improved fuel/air mixing and volumetric efficiency;

(3) elimination of combustion knock;

(4) elimination of carburetor icing; and (5) more uniform distribution of fuel to engine cylinders.

However, fuel injectors presently available are relatively complex and expensive in comparison with carburetors. For example, fuel injectors commonly used on automotive gasoline engines require electronic control units, power supplies, and auxiliary fuel pumps. Because of their high cost and dependence on these components, fuel injectors have found widespread use only on engines designed for highway vehicles, aircraft, and other relatively expensive equipment. Thus far, it has not been economically feasible to equip smaller, lower horsepower equipment, such as garden tractors powered by two cycle gasoline engines, with fuel injectors. However, increasing concerns over air pollution will eventually require that even small, lower horsepower engines meet the strict hydrocarbon emissions standards presently applicable to the larger engines.

Consequently, a need exists for a simple, lightweight, low cost fuel injector for small internal combustion engines, particularly two cycle gasoline engines. Preferably, such a fuel injector will not require auxiliary electronic components, power supplies, fuel pumps, or other auxiliary equipment.

SUMMARY OF THE INVENTION

Apparatus for injecting fuel into an internal combustion engine having an air inlet containing an adjustable air throttle valve comprises a hollow plunger barrel fitted internally with a plunger piston for reciprocating motion, and defining a variable volume fuel pumping chamber and a variable volume compression chamber. A fuel supply means is connected to the pumping chamber. A fuel passage means interconnects the fuel pumping chamber, the compression chamber, and the fuel supply means. An air supply means is connected to the fuel passage means, and a fuel/air discharge means is connected to the compression chamber. The fuel/air discharge means is connected to an injector nozzle located in the engine for injecting a mixture of fuel and air into the engine for combustion. An actuator means operably interconnects the plunger piston and the engine for reciprocating the piston within the plunger barrel.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
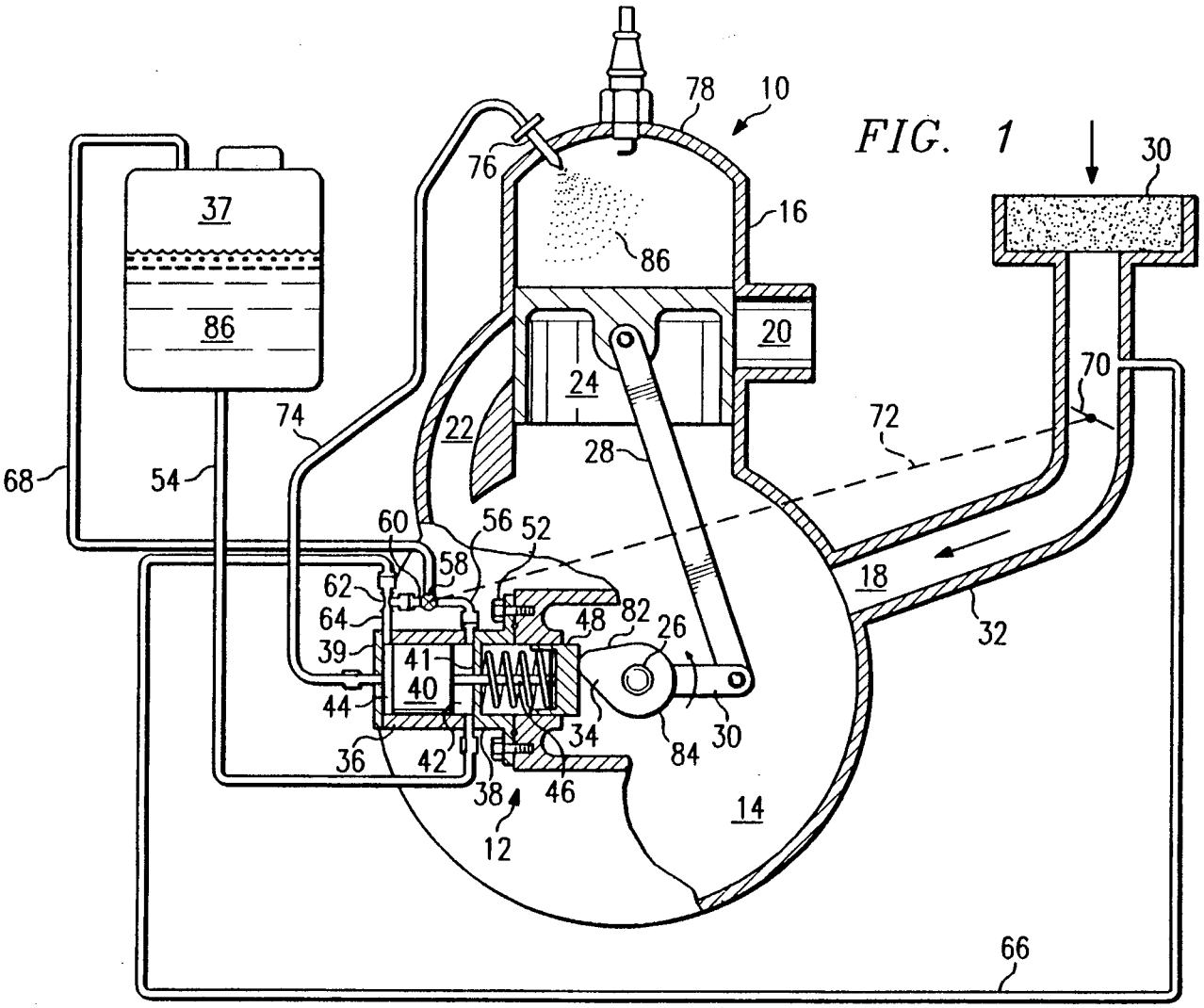
FIG. 1 is a side elevational view, partially in cross section, of a two cycle gasoline engine equipped with the fuel injector of this invention.

The preferred embodiment of the present invention and its advantages are best understood by referring to the drawings, like numerals being used for like and corresponding parts of the various drawings.

In FIG. 1 there is shown, partially in cross section, a two stroke gasoline engine, generally designated 10, equipped with an integrated fuel pump and fuel injector 12 of the present invention. As seen in FIG. 1, the engine 10 includes a crank case 14, a cylinder 16, an inlet port 18, an exhaust port 20, a transfer port 22, a piston 24, and a camshaft 26. A piston rod 28 and a crank arm 31 interconnect the camshaft 26 with the piston 24. Air is supplied to the crankcase 14 through air filter 30 and air duct 32, which leads from air filter 30 to inlet port 18. The camshaft 26 turns a cam 34, which operates the fuel injector 12. Fuel is supplied to fuel injector 12 from fuel tank 37.

Figure 2:
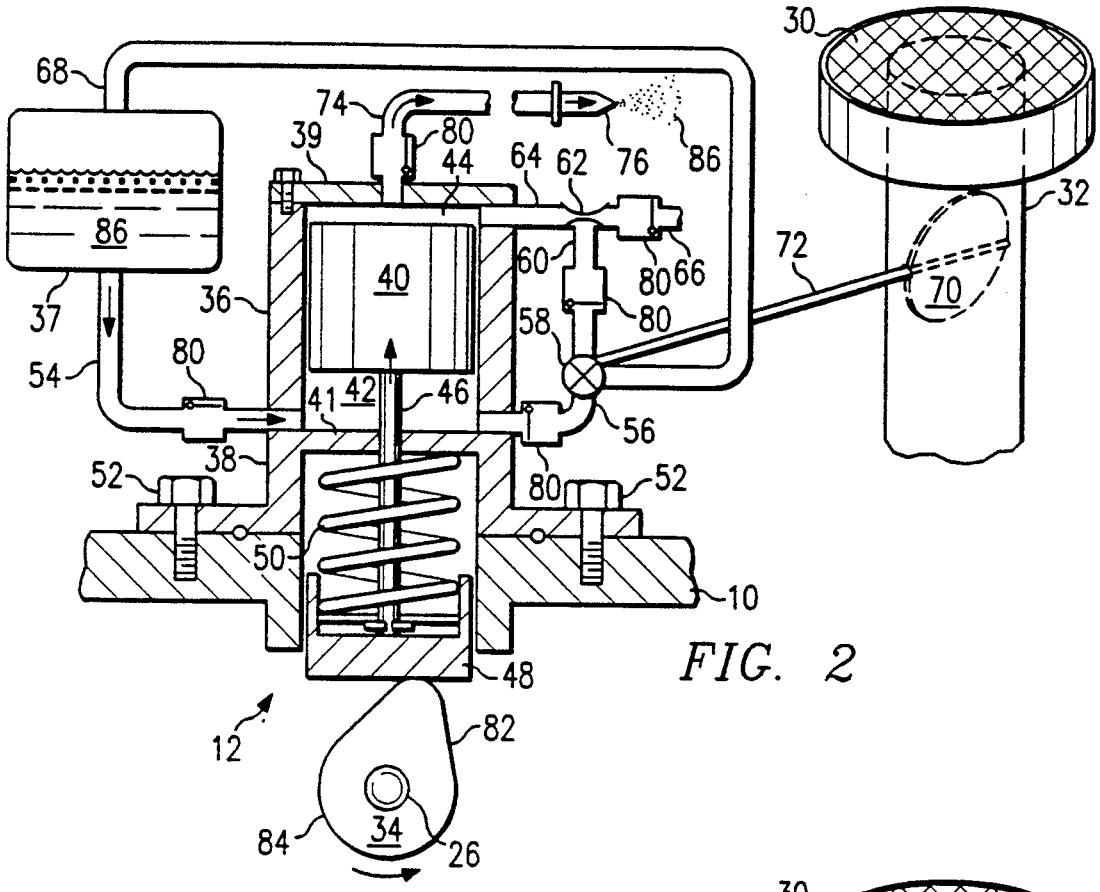
FIG. 2 is an enlarged cross-sectional view, partially schematic, of the fuel injector of this invention during the fuel pumping and fuel injecting stroke of the plunger piston.

Referring now to FIG. 2, fuel injector 12 includes a hollow cylindrical injector body plunger barrel 36 attached to a base 38. The plunger barrel is closed on its upper end, as viewed in FIG. 2, by a compression head 39, and on its lower end by a pump head 41 on base 38. A cylindrical plunger piston 40 is fitted in the plunger barrel 36 for reciprocating motion therein. Two variable volume chambers are defined by these components. Plunger barrel 36, compression head 39, and the front or top side of piston 40 enclose a fuel compression or injecting chamber 44. Plunger barrel 36, pump head 41, and the back or lower side of piston 40 define a fuel pumping chamber 42.

A piston shaft 46 connects piston 40 with a cam follower 48, which engages cam 34. A compression spring 50 housed partially within base 38 maintains cam follower 48 in contact with cam 34 throughout its revolution by camshaft 26. The injector base 38 is attached to engine 10 by any suitable means, such as by mechanical fasteners 52.

Fuel pumping chamber 42 is connected with fuel tank 37 by fuel supply conduit or tube 54. A fuel discharge conduit or tube 56 leads from pumping chamber 42 to the inlet port of a fuel bypass valve 58. A fuel transfer conduit or tube 60 leads from a first outlet port on fuel bypass valve 58 to an air fed mixing venturi 62. A fuel-/air supply conduit or tube 64 leads from the discharge port of air fed mixing venturi 62 to fuel pumping chamber 42 of fuel injector 12. Filtered air is supplied to the air fed mixing venturi 62 by an air supply conduit or tube 66 connected to air duct 32, as seen in FIG. 1.

Referring again to FIG. 2, a fuel bypass conduit or tube 68 leads from a second outlet port of fuel bypass valve 58 to the top of fuel tank 37. The position of bypass valve 58 is controlled by an air throttle valve 70 in air duct 32. An appropriate linkage 72 connects air throttle valve 70 with fuel bypass valve 58. A fuel injection conduit or tube 74 leads from fuel pumping chamber 42 to a fuel injection nozzle 76 located in the cylinder head 78 of engine 10. Alternatively, nozzle 76 could be located to inject fuel into transfer port 22 or into intake port 18 of engine 10. Each of tubes 54, 56, 60, 66, and 74 contain a check valve 80 to permit fuel and/or air to flow in only one direction through the tube.

Figure 3:
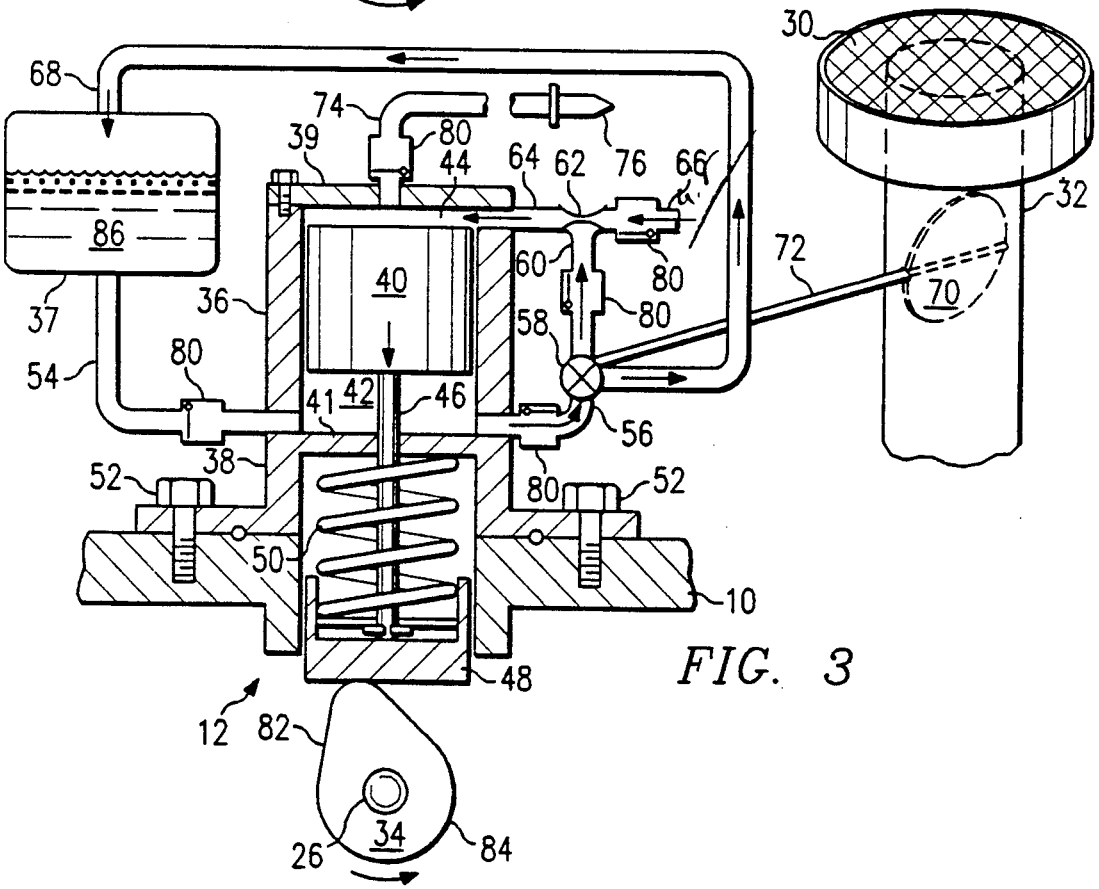
FIG. 3 is the fuel injector of FIG. 2 during the fuel transfer stroke of the plunger piston.

Fuel injector 12 operates to pump fuel from fuel tank 37, mix the fuel with air, and inject the fuel/air mixture into engine 10 as follows: Cam 34 rotates with engine camshaft 26. The rotation of cam 34 brings cam follower 48 in alternating engagement with cam lobe 82 and cam flat 84, causing cam follower 48 to reciprocate plunger piston 40 within plunger barrel 36 by piston shaft 46. As plunger piston 40 moves upward as seen in FIG. 2, check valve 80 in fuel supply tube 54 is open, check valve 80 in fuel discharge tube 56 is closed, and fuel 86 is thus drawn from fuel tank 37 to fuel pumping chamber 42 through fuel supply tube 54. Referring now to FIG. 3, as piston 40 moves downward, the fuel 86 in fuel pumping chamber 42 is forced through fuel discharge tube 56 to the inlet port of fuel bypass valve 58. During this downward stroke of piston 40, a check valve 80 in fuel supply tube 54 is closed, preventing the backflow of fuel 86 to fuel tank 37.

Bypass valve 58 is controlled by air throttle valve 70 in air duct 32. Referring to FIG. 3, when the engine 10 is operating at maximum load condition, air throttle valve 70 is fully opened and bypass valve 58 directs all of the fuel 86 entering its inlet port to air fed mixing venturi 62 through fuel transfer tube 60. As engine load decreases and air throttle valve 70 partially closes to restrict air flow to engine 10, bypass valve 58 diverts a portion of entering fuel 86 to fuel tank 37 by fuel bypass tube 68. When engine 10 is operating at its minimum power or idle condition, air throttle valve 70 is almost completely closed, and bypass valve 58 diverts substantially all of entering fuel 86 to fuel tank 37, and only a minimum quantity of fuel 86 to air fed mixing venturi 62. The fuel 86 pressure drop across bypass valve 58 resulting from diversion of a portion of fuel 86 to fuel tank 37 causes air to be drawn into air fed mixing venturi 62 through air supply tube 66. The air entrained into fuel 86 through air fed mixing venturi 62 mixes thoroughly with fuel 86 before it enters fuel injecting chamber 44. The amount of air entrained into fuel 86 is in direct proportion to the pressure drop across fuel bypass valve 58, which in turn is directly proportional to the quantity of fuel 86 diverted by bypass valve 58 to fuel tank 37. Thus, air entrainment in fuel 86 reaches its maximum when engine 10 is operating at idle conditions, and its minimum when engine 10 is operating at full load condition, when maximum fuel delivery to engine 10 is required.

The downward motion of plunger piston 40, as described above and illustrated in FIG. 3, forces fuel 86 from fuel pumping chamber 42 to bypass valve 58, where it is directed to fuel injecting chamber 44 through air fed mixing venturi 62 and/or to fuel tank 37 through fuel bypass tube 68. Referring again to FIG. 2, the upward motion of piston 40, in addition to pumping fuel 86 from fuel tank 37 to fuel pumping chamber 42 as described above, also pumps the fuel/air mixture from fuel injecting chamber 44 to fuel injection nozzle 76 through fuel injection tube 74. During this upward stroke of piston 40, check valves 80 in fuel transfer tube 60 and in air supply tube 66 are closed to prevent the backflow of fuel from fuel injecting chamber 44. During the downward motion of piston 40 (FIG. 3), a check valve 80 in fuel injection tube 74 closes to prevent the backflow of fuel through tube 74 to fuel injecting chamber 44. Thus, for each revolution of camshaft 26, piston 40 performs the multiple functions of fuel pumping, fuel/air mixing, and fuel injection.

Several advantages are realized by the fuel injector disclosed herein. First, the fuel pumping, fuel injecting, and fuel/air mixing functions are performed by a single, integrated, double-acting plunger piston and barrel without the need for an electronic control module, electric power supply, auxiliary fuel pump, or other accessory equipment. Second, the flow rate of fuel to the engine is properly metered for the engine's actual operating load by controlled displacement of fuel with air. Third, at light engine operating loads, the fuel is properly mixed with air for improved combustion, improved fuel economy, and reduced hydrocarbon emissions. Fourth, the manufacturing cost of this fuel injector is very low compared to previous fuel injectors. Finally, the simplicity, light weight, and low cost of the fuel injector of this invention makes available to small, low horsepower engines, for which fuel injection was previously not technically or economically feasible, the improved fuel economy, reduced hydrocarbon emissions, and other demonstrated advantages of fuel injection technology.

The mechanical fuel injector apparatus of the present invention, and many of its intended advantages, will be understood from the foregoing description and it will be apparent that, although the invention and its advantages have been described in detail, various changes, substitutions, and alterations may be made in the manner, procedure, and details thereof without departing from the spirit and scope of the invention, as defined by the appended claims, or sacrificing all of its material advantages, the form hereinbefore described being merely a preferred or exemplary embodiment thereof.

What is claimed is:

1. An apparatus for injecting fuel into an internal combustion engine having an air inlet containing an adjustable air throttle valve, comprising:

a hollow injector body having a cylindrical bore therein;

a compression head closing one end of said bore;

a pump head closing an opposite end of said bore;

a plunger piston reciprocally moveable within said cylinder bore defining a variable volume fuel pumping chamber formed by said injector body, said compression head, and a first end of said piston, and a variable volume compression chamber formed by said injector body, said pump head and a second end of said piston;

fuel supply means connected to said pumping chamber;

fuel passage means interconnecting said pumping chamber, said compression chamber and said fuel supply means;

air supply means connected to said fuel passage means;

fuel/air discharge means connected to said compression chamber;

an injection nozzle located in said engine and connected to said fuel/air discharge means for injecting a mixture of fuel and air into said engine for combustion therein; and actuator means operably interconnecting said piston and said engine for reciprocating said piston within said cylinder bore of said injector body.

2. The fuel injecting apparatus of claim 1, wherein said fuel passage means includes a fuel bypass valve for controllably diverting fuel from said pumping chamber to said fuel supply means.

3. The apparatus of claim 1, wherein said air supply means connected to said fuel passage means includes an air fed mixing venturi.

4. The apparatus of claim 2, wherein said fuel bypass valve is operably connected to, and is responsive to, the position of the air throttle valve on said engine.

5. The apparatus of claim 2, wherein said fuel passage means includes means for preventing the backflow of fuel to said pumping chamber and to said fuel bypass valve.

6. The apparatus of claim 5, wherein said means for preventing the backflow of fuel is a check valve located in a conduit leading from said pumping chamber and in a conduit leading from said fuel bypass valve.

7. The apparatus of claim 3, wherein said air supply means includes means for preventing the backflow of air or fuel through said mixing venturi.

8. The apparatus of claim 3, wherein said air supply means includes an air filter.

9. The apparatus of claim 7, wherein said means for preventing the backflow of air or fuel is a check valve located in a conduit leading to said mixing venturi.

10. The apparatus of claim 1, wherein said fuel supply means includes a fuel tank and a conduit connecting said tank with said pumping chamber.

11. The apparatus of claim 10, further including means for preventing the backflow of fuel to said fuel tank.

12. The apparatus of claim 11, wherein said means for preventing the backflow of fuel to said fuel tank is a check valve located in said conduit connecting said tank with said pumping chamber.

13. The apparatus of claim 1, wherein said fuel/air discharge means includes a conduit containing a check valve for preventing the backflow of fuel or air to said compression chamber.

14. The apparatus of claim 1, wherein said engine includes a rotatable cam shaft, and wherein said actuator means operably interconnecting said piston and said engine includes:

a cam located on and rotated by said engine cam shaft and having a lobe thereon;

a reciprocating cam follower having a surface engaging said cam;

a shaft connecting said cam follower with said piston; and means for maintaining said surface of said cam follower in engagement with said cam.

15. The apparatus of claim 14, wherein said means for maintaining said cam follower surface in engagement with said cam includes a spring having one end engaging said cam follower and an opposite end fixed relative to said cam follower.

16. The apparatus of claim 1, wherein said engine is a two-stroke, spark ignition engine, and wherein said fuel is gasoline.

17. An integrated fuel pump and fuel injector for an internal combustion engine having an adjustable air throttle valve, which comprises, in combination:

a hollow plunger barrel having a cylindrical bore therein;

a compression head closing one end of said bore;

a pump head closing an opposite end of said bore;

a plunger piston fitted for reciprocating movement within said cylinder bore defining a variable volume fuel pumping chamber formed by said plunger barrel, said compression head, and a first end of said piston, and a variable volume fuel injecting chamber formed by said plunger barrel, said pump head and a second end of said piston;

fuel supply means connected to said pumping chamber;

fuel passage means interconnecting said pumping chamber, said injecting chamber, and said fuel supply means;

air supply means connected to said fuel passage means;

fuel/air discharge means connected to said injecting chamber;

an injection nozzle located in said engine and connected to said fuel/air discharge means for injecting a mixture of fuel and air into said engine for combustion therein; and actuator means operably interconnecting said piston and said engine for reciprocating said piston within said cylindrical bore of said plunger barrel.

18. The pump and injector of claim 17, wherein said fuel passage means includes adjustable valve means for metering the flow rate of fuel from said pumping chamber to said injecting chamber.

19. The pump and injector of claim 18, wherein said adjustable valve means is a fuel bypass valve.

20. The pump and injector of claim 19, wherein said fuel bypass valve is operably connected to, and is responsive to, the position of the air throttle valve on said engine.

21. The pump and injector of claim 19, wherein said fuel passage means includes means for preventing the backflow of fuel to said pumping chamber and to said fuel bypass valve.

22. The pump and injector of claim 21, wherein said means for preventing the backflow of fuel is a check valve located in a conduit leading from said pumping chamber, and in a conduit leading from said fuel bypass valve.

23. The pump and injector of claim 17, wherein said air supply means includes fuel/air mixing means.

24. The pump and injector of claim 23, wherein said fuel/air mixing means includes an air fed mixing venturi connected to said air supply means and to said fuel passage means.

25. The pump and injector of claim 17, wherein said air supply means includes means for preventing the backflow of air or fuel through said mixing venturi.

26. The pump and injector of claim 25, wherein said means for preventing the backflow of air or fuel through said mixing venturi is a check valve located in a conduit leading to said mixing venturi.

27. The pump and injector of claim 17, wherein said air supply means includes an air filter.

28. The pump and injector of claim 17, wherein said fuel/air discharge means includes a conduit containing means for preventing the backflow of fuel or air to said injecting chamber.

29. The pump and injector of claim 28, wherein said means for preventing the backflow of fuel or air to said injecting chamber is a check valve.

30. The pump and injector of claim 17, wherein said actuator means operably interconnecting said piston and said engine includes:

cam means operable by said engine; and driving means connecting said cam means with said piston.

31. The pump and injector of claim 30, wherein said cam means includes:

a cam rotatable by said engine;

a reciprocating cam follower having a surface engaging said cam; and resilient means for maintaining said surface of said cam follower in engagement with said cam as said cam is rotated by said engine.

32. The pump and injector of claim 31, wherein said resilient means includes a spring having one end engaging said cam follower and an opposite end fixed relative to said cam follower.

33. The pump and injector of claim 30, wherein said driving means connecting said cam means with said piston is a shaft.

34. The pump and injector of claim 17, wherein said fuel supply means includes a fuel tank and a conduit connecting said tank with said pumping chamber.

35. The pump and injector of claim 34, further including means for preventing the backflow of fuel to said fuel tank.

36. The pump and injector of claim 35, wherein said means for preventing the backflow of fuel to said fuel tank is a check valve located in said conduit connecting said tank with said pumping chamber.

37. The pump and injector of claim 17, wherein said engine is a two-stroke, spark ignition engine, and wherein said fuel is gasoline.

38. An apparatus for injecting fuel into an internal combustion engine having an air inlet containing an adjustable air throttle valve, comprising:

a hollow injector body having a cylindrical bore therein;

a compression head closing one end of said bore;

a pump head closing an opposite end of said bore;

a plunger piston reciprocally moveable within said cylinder bore defining a variable volume fuel pumping chamber formed by said injector body, said compression head, and a first end of said piston, and a variable volume compression chamber formed by said injector body, said pump head and a second end of said piston;

fuel supply means connected to said pumping chamber by a conduit having a check valve for preventing backflow of fuel from said pumping chamber to said fuel tank;

fuel passage means interconnecting said pumping chamber and said compression chamber having a check valve for preventing backflow of fuel from said compression chamber to said pumping chamber;

a bypass valve disposed in said fuel passage means for controllably diverting fuel forced from said pumping chamber by said piston to said fuel supply means;

air supply means connected to said fuel passage means;

a fuel/air discharge conduit connected to said compression chamber;

an injection nozzle located in said engine and connected to said fuel/air discharge means for injecting a mixture of fuel and air into said engine for combustion therein; and actuator means operably interconnecting said piston and said engine for reciprocating said piston within said cylinder bore of said injector body.

39. An apparatus for injecting fuel into an internal combustion engine having an air inlet containing an adjustable air throttle valve, comprising the steps of:

drawing fuel from a fuel supply to a variable volume pumping chamber by reciprocating a plunger piston defining a movable surface of the pumping chamber such that the volume of the pumping chamber increases;

forcing fuel from the pumping chamber to a variable volume compression chamber through a fuel passage line by reciprocating the plunger piston such that the volume of the pumping chamber decreases and the volume of the compression chamber increases;

diverting a portion of the fuel forced from the pumping chamber in a bypass valve disposed in the fuel passage line to return to the fuel source in response to the adjustable air throttle valve such that the appropriate fuel/air combination is provided to the engine for the actual operating load of the engine;

mixing air with the fuel in the fuel passage line prior to the fuel entering the compression chamber; and injecting the fuel by reciprocating the plunger piston.

* * * * *